United States Patent [19]

Illis et al.

[11] 4,135,913

[45] Jan. 23, 1979

[54] THERMAL CONCENTRATION OF NON-FERROUS METAL VALUES IN SULFIDE MINERALS

[75] Inventors: Alexander Illis, Mississauga; Louis S. Renzoni, Toronto, both of Canada

[73] Assignee: The International Nickel Company, Inc., New York, N.Y.

[21] Appl. No.: 621,343

[22] Filed: Oct. 10, 1975

Related U.S. Application Data

[63] Continuation of Ser. No. 399,440, Sep. 21, 1973, abandoned.

[30] Foreign Application Priority Data

Oct. 27, 1972 [CA] Canada ..... 155032

[51] Int. Cl.[2] ..... C22B 23/00

[52] U.S. Cl. ..... 75/21; 75/1 R; 75/3; 75/29; 75/82; 423/138

[58] Field of Search ..... 75/1 R, 1, 3, 4, 5, 75/6, 7, 82, 89, 21, 29; 423/138

[56] References Cited

U.S. PATENT DOCUMENTS

| | | | |
|---|---|---|---|
| 2,082,284 | 6/1937 | Gootz | 75/6 |
| 3,053,651 | 9/1962 | McGauley | 75/1 R |
| 3,388,870 | 6/1968 | Thumm et al. | 241/123 |
| 3,656,935 | 4/1972 | Iwasaki | 75/82 |
| 3,754,896 | 8/1973 | Iwasaki | 75/82 |

FOREIGN PATENT DOCUMENTS

| | | | |
|---|---|---|---|
| 498718 | 12/1953 | Canada | 75/1 R |
| 781043 | 2/1935 | France. | |
| 2167821 | 8/1973 | France. | |
| 42-24643 | 11/1967 | Japan. | |
| 4532 | 7/1969 | Philippines. | |
| 7354297 | 3/1973 | Sweden. | |
| 659283 | 10/1951 | United Kingdom | 75/82 |
| 1080210 | 8/1967 | United Kingdom | 75/82 |

OTHER PUBLICATIONS

Chemical Abstracts, vol. 75, item 8728n, 1971.

Manuscript for Approval Letter; U.S. Dept. of Interior, 1/7/72 for Carriere, et al.

Letter of J. E. Lawver to Norwood B. Melcher of 6/30/71 from University of Minnesota.

Letter of Norwood B. Melcher to C. S. Simons, 7/20/71 from U.S. Dept. of Interior.

Letter of Warren McMahan to R. R. Wells of 1/7/72 from U.S. Dept. of Interior.

Letter of J. E. Lawver to R. B. Schulter of 1/31/72, from University of Minnesota.

Carriere, B. W., et al. et al. "A Roasting Process for Extracting Copper and Nickel from Suluth Gabbro", Annual Mining Symposium, Duluth, Minn. of Jan. 17–19, 1972; Published 5/12/72, pp. 1–9, 11–14.

*Primary Examiner*—L. Dewayne Rutledge
*Assistant Examiner*—Michael L. Lewis
*Attorney, Agent, or Firm*—Miriam W. Leff; Ewan C. MacQueen

[57] ABSTRACT

Ferruginous sulfide minerals containing non-ferrous metal values, such as nickel and cobalt are treated to concentrate the non-ferrous metal values in metallic iron. An intimate admixture of finely-divided non-ferrous-metal-bearing ferruginous sulfide minerals, iron oxide, and a suitable reducing agent is maintained at a temperature between about 800° C. and 1000° C. in an atmosphere non-oxidizing to iron to produce a metallic iron alloy containing the non-ferrous metal values from the sulfide minerals. The heated admixture is cooled and the concentrated non-ferrous metal values in the iron alloy are recovered by magnetic separation or hydrocloning.

26 Claims, No Drawings

THERMAL CONCENTRATION OF NON-FERROUS METAL VALUES IN SULFIDE MINERALS

This is a continuation of application Ser. No. 399,440, filed Sept. 21, 1973, now abandoned.

The present invention relates to the beneficiation of non-ferrous-metal-containing sulfide materials, and more particularly to the thermal concentration of non-ferrous metal values contained in ferruginous sulfide minerals.

The most common nickel-bearing minerals in sulfide ores are pentlandite and pyrrhotite. Pentlandite corresponds to the formula $(Ni,Fe)_9S_8$, which contains about 34% nickel, and is readily treated for nickel recovery. Pyrrhotite is not properly classified as a nickel mineral but is an irondeficient sulfide, corresponding to the formula $Fe_xS_{x+1}$ wherein x is a whole number greater than 1, in which minor amounts of nickel are randomly substituted for the iron. In most instances, the nickel content of pyrrhotite rarely exceeds about 2% so that great volumes of pyrrhotite must be treated to recover relatively minor amounts of nickel.

After mining, nickel-bearing sulfide ores are comminuted and then beneficiated to reduce the amount of ore that must be treated for nickel recovery. Most commonly, the comminuted ore is bulk floated to produce a rougher concentrate that contains most of the nickel in the ore as pentlandite and most of any of the copper values as chalcopyrite and rougher tailings that contain gangue and most of the pyrrhotite. The bulk concentrate can, if copper is present, be selectively floated to provide separate nickel and copper concentrates which can be individually treated to recover nickel and copper. The rougher tailings are further treated to provide a scavenger concentrate which, after additional treatment, provides an iron concentrate that is primarily a nickel-containing pyrrhotite with a nickel content generally below about 1.5%.

The scavenger and/or iron concentrate can be combined with the nickel concentrate for further treatment to recover the nickel values. However, where possible, it is preferred to separately treat the pyrrhotite to recover nickel values and to produce iron ore. In conventional smelting practice, iron is progressively oxidized in roasters, reverberatory furnaces and converters so that oxidized iron can be removed by slagging in the reverberatory furnace and in the converter. All of these operations, in most instances, produce off-gases very lean in sulfur dioxide, which makes recovery of sulfur dioxide from the off-gases difficult and unduly expensive.

Presently, the scavenger and/or iron concentrate is separately treated to recover nickel, iron and sulfur in useful forms. Nickeliferous pyrrhotite is fluid bed roasted to give a low sulfur calcine and an off-gas sufficiently enriched in sulfur dioxide to allow the recovery of sulfuric acid therefrom. Since the amount of sulfur in the iron concentrate is generally about 20 times the amount of nickel, large amounts of sulfuric acid are generated if the sulfur dioxide is recovered. The production of sulfuric acid while serving to largely eliminate sulfur dioxide emissions from the process cannot be economically expanded as an oversupply of acid is already available within a reasonable shipping distance of many smelters. Reduction of sulfur dioxide to elemental sulfur which may be stockpiled is also an expensive method of curtailing sulfur dioxide emissions from the process. The hot calcine is selectively reduced to reduce most of the nickel and only controlled amounts of iron. Nickel and other non-ferrous values are recovered from the selectively reduced ore by leaching with an aerated ammoniacal ammonium carbonate solution, and the leached solids, after suitable washing, are pelletized and sintered to produce high-grade iron oxide pellets. The pregnant leach solution is treated for nickel recovery.

As seen from the foregoing brief description, whether the scavenger or iron flotation concentrate is combined with the nickel flotation concentrate or treated separately, numerous operations that involve large capital expenditures for roasting, smelting and converting apparatus and large operating costs, including fuel and other reagents, are required to handle the large amounts of pyrrhotite with a high sulfur content to recover relatively small amounts of nickel. Although attempts were made to overcome the foregoing difficulties and other disadvantages, none, as far as we are aware, was entirely successful when carried into practice commercially on an industrial scale.

It has now been discovered that non-ferrous values contained in ferruginous sulfide minerals can be concentrated by treating the ferruginous sulfide mineral with special reagents at controlled temperatures under specially controlled atmospheres to provide metallic iron in which the non-ferrous values are concentrated and then the non-ferrous metal values can be recovered by separating the metallic iron from the bulk of the ferruginous sulfide mineral.

It is an object of the present invention to provide a process for concentrating non-ferrous values contained in ferruginous sulfide minerals.

Another object of the invention is to provide a process for concentrating nickel values contained in nickel-bearing ferruginous sulfide minerals by thermally treating the ferruginous sulfide minerals in a manner which largely eliminates the production of sulfur dioxide.

Another object of the present invention is to provide a process for thermally treating a nickel-containing ferruginous sulfide material to concentrate the nickel values in a metallic iron concentrate which is easily separated from the ferruginous sulfide mineral.

Yet another object of the present invention is to provide a thermal upgrading process for sulfide ores in which most of the sulfur in the sulfide material remains as a sulfide throughout the process and is a discardable product low in non-ferrous values at the end of the process.

Generally speaking, the present invention contemplates a process for concentrating non-ferrous values contained in ferruginous sulfide minerals containing non-ferrous values. An intimate admixture of finely-divided non-ferrous metal-value-containing ferruginous sulfide mineral, iron oxide and a suitable reducing agent is agglomerated. The agglomerates are heated to and maintained at a temperature between about 800° C. and 1000° C. in an atmosphere non-oxidizing to metallic iron to reduce the iron oxide to metallic iron and to concentrate nonferrous metal values into the metallic iron from the sulfide minerals. The metallic iron with the non-ferrous metal values concentrated therein is separated from the ferruginous sulfide minerals after cooling and comminuting the agglomerates.

More particularly, the present invention contemplates a process for concentrating nickel values contained in nickel-bearing ferruginous sulfide minerals. An intimate admixture of finely-divided nickel-bearing ferruginous sulfide minerals and an iron oxide with suitable reducing agent is agglomerated. The agglomerates are heated to and maintained at a temperature between about 800° C. and 1000° C. in an atmosphere non-oxidizing to metallic iron to reduce the iron oxide to metallic iron and to diffuse nickel values into the metallic iron from the sulfide minerals. The agglomerates are cooled and comminuted, and the metallic iron is separated from the sulfide minerals in the cooled admixture to provide a concentrate of metallic iron with nickel values concentrated therein.

Non-ferrous metal values that can be recovered include, although the invention is not limited thereto, nickel and cobalt. Examples of non-ferrous-metal-value-bearing ferruginous sulfide minerals, although the invention is not intended to be limited thereby, are: pyrrhotite and pentlandite. Although the process in accordance with the present invention can be employed to concentrate non-ferrous values contained in the aforementioned ferruginous sulfide minerals, the following description will be limited to the concentration of nickel values contained in pyrrhotite in order to facilitate the description of the present invention but the skilled artisan will readily appreciate that other non-ferrous metal values can be concentrated in a similar manner.

Pentlandite, the mineral containing a preponderant part of the nickel in nickeliferous sulfide ores, can be efficiently treated by well known means. The nickeliferous sulfide ore is crushed and ground to liberate the sulfide minerals from the rock so that pentlandite can be separately recovered by flotation. In most instances, grinding to at least about 75% minus 65 mesh and advantageously more than about 85% minus 65 mesh is resorted to. It will be noted that mesh sizes given herein are for U.S. Standard Screen Sizes. After grinding, the crushed ore is subjected to a bulk flotation treatment to provide a bulk concentrate that contains substantially all the pentlandite and any chalcopyrite while the tailings contain not only the rock but the less floatable pyrrhotite. The rougher tailings are subjected to a second flotation treatment to provide a scavenger concentrate that contains substantially all of the pyrrhotite. This scavenger concentrate is re-ground to a particle size of at least about 80% minus 200 mesh, and most frequently about 90% minus 200 mesh, and subjected to a recleaning operation to remove additional copper-nickel values.

Although the nickel-bearing pyrrhotite can be admixed with metallic iron to concentrate nickel values, it is advantageous to roast a portion of the pyrrhotite concentrate to provide a calcine having a sulfur content of less than about 5%, and then to form a mixture of the remaining pyrrhotite concentrate and the calcine together with a reductant to form metallic iron in situ when the mixture of pyrrhotite, calcine and reductant are heated to temperatures between about 800° C. and 970° C. Advantageously, sufficient amounts of pyrrhotite are roasted to provide a calcine to pyrrhotite ratio of between about 0.15:1 and 5:1. One of the advantages flowing from the use of roasted pyrrhotite is that the nickel associated with the roasted pyrrhotite is also recovered in the concentrate. Of course, if a suitable iron oxide material is available it could be substituted for the roasted pyrrhotite in the agglomerated charge. Also, if a suitable metallic iron powder is available it may be substituted for the iron oxide plus the reductant. Similarly, the required metallic phase can be produced in situ by substituting a mole equivalent of alkali or alkaline earth oxide for the iron oxide. Advantageously, this oxide is added in the form of calcium oxide.

When an admixture of pyrrhotite and roasted pyrrhotite is employed to form metallic iron in situ, a solid reductant is advantageously incorporated in the admixture to provide high reduction potentials whereby improved reduction kinetics are realized. If a solid reductant is added to the admixture, it is advantageously added in a particulate form with a particle size of at least about 80% minus 65 mesh and even more advantageously about 80% minus 65 mesh. Examples of particulate reductants are comminuted coke, charcoal or coal. Whatever the form of the reductant, it is added in amounts between about 20% and 70% calcine in the calcine to pyrrhotite admixture and advantageously in amounts between about 25% and 50%. The foregoing amounts of reductants insure complete reduction of the roasted pyrrhotite while minimizing losses of the reductant to the pyrrhotite upon cooling and separation of the metallic iron concentrate.

Although the admixtures of pyrrhotite, calcine and reductant can be heated as a mixture of finely-divided constituents to the reaction temperatures, it is advantageous to pelletize the admixtures to minimize problems associated with sticking in the furnaces and in order to insure that good solid-solid contact is maintained between the metallic or reduced calcine and the pyrrhotite. The admixture can be agglomerated by well known means such as pelletizing or briquetting.

The nickel values in the pyrrhotite are concentrated into metallic iron, whether the metallic iron is added as such or is produced in situ, by heating the admixture to a temperature between about 800° C. and 1000° C. and advantageously to a temperature between about 850° C. and 925° C. When the admixture comprises pyrrhotite, calcine and reductant, such heating is effective not only in diffusing nickel values into metallic iron but also in promoting reduction of the calcine. Since at the higher temperatures the pyrrhotite oxide mixture approaches its incipient fusion temperature, care must be exercised in avoiding problems associated with sticking and undue agglomeration. Lower temperatures than those within the foregoing ranges can be employed but the rate of reduction and diffusion is so slow that the process soon becomes uneconomical.

Heating of the admixture of calcine, pyrrhotite and reductant is conducted in an atmosphere that is neutral or slightly reducing in order to avoid oxidation of reduced metallic iron. Oxidized iron displays only limited solubility for nickel values. In most instances, the admixture is heated to and held at the foregoing temperatures in an atmosphere that has a reducing potential equivalent to a $CO:CO_2$ ratio of between about 1:2 and 2:1, and most advantageously between about 1:1.5 and 1.5:1. When the admixture is formed from calcine and pyrrhotite within the aforedescribed size ranges and the admixture is maintained at a temperature between about 800° C. and 1000° C., a preponderant part of the nickel associated with the pyrrhotite will concentrate into the metallic iron in about 10 minutes to about 120 minutes. Heating times within the foregoing range insure that substantially all the nickel, e.g., at least about 70%, associated with the pyrrhotite is diffused into the metallic iron. When substantially all of the nickel associated with the pyrrhotite has been diffused into the metallic iron, the admixture is cooled without oxidizing the metallic iron concentrate. In most instances, cooling rates of less than about 100° C. per minute have little effect on the nickel recovery achieved by magnetic separation.

In order to physically separate the metallic alloy from the treated charge, the cooled admixture is crushed to liberate metallic alloy. Since the heat treatment is effected at temperatures below the incipient fusion point of pyrrhotite and metallic iron and since the heat treatment is conducted for relatively short periods of time, the cooled admixture is readily crushed to separation fineness by conventional milling techniques. Best results are obtained by crushing the cooled admixture to a particle size of at least about 80% minus 200 mesh and most advantageously about 95% minus 200 mesh.

The metallic alloy having the nickel values concentrated therein is separated from the ground admixture of iron sulfide and metallic alloy by magnetic separation. The metallic alloy is magnetic while the remaining iron sulfide is non-magnetic so that the concentrate can be recovered by conventional magnetic separation technique.

As noted hereinbefore, it is advantageous to agglomerate the admixture of pyrrhotite and calcine or metallic iron in order to avoid the problems associated with sticking when the admixture is heated to the temperatures within the aforedescribed ranges. It has been found that the process can be carried out in a rotary furnace without serious sticking problems provided the temperature is maintained below about 900° C. When using a rotary hearth type of furnace or a moving belt furnace in which the agglomerated feed does not move relative to the hearth, the use of higher temperatures becomes practicable. The process in accordance with the present invention can then be carried out in a number of different types of furnaces commonly in use, subject to the aforementioned temperature limitations.

For the purpose of giving those skilled in the art a better understanding of the invention, the following illustrative examples are given:

EXAMPLE I

Three parts of nickeliferous pyrrhotite containing about 1.25% nickel and ground to a particle size of 90% minus 200 mesh was mixed with one part of calcine (i.e., the same pyrrhotite roasted at 850° C. to a sulfur content of 0.2%) and 0.7 part of finely ground bituminous coal. The admixture was pressed into pillow shaped briquettes of approximately 3 centimeters by 2 centimeters by 1 centimeter and heated in a slightly reducing atmosphere (9.5% carbon dioxide, 5% water vapor, 9.5% carbon monoxide, 9.5% hydrogen and 66.5% nitrogen) at a temperature of 870° C. for ½ hour. After this thermal treatment the charge was cooled in a non-oxidizing atmosphere, ground in a wet pebble mill to 95% minus 325 mesh and subjected to wet magnetic separation at 2800 gauss. The results of this test are given in Table I. As can be seen from the results in Table I, 89% of the nickel associated with the pyrrhotite and the calcine reported in the magnetic fraction to provide a magnetic concentrate that contained 8.3% nickel. As also shown in Table I the non-magnetic fraction which comprises 87.3% of the admixture had a nickel content of only 0.15%. Thus, the amount of material that must be treated to ultimately recover the nickel values contained in the original pyrrhotite is only ⅛ of the original mass. As also shown in Table I, the non-magnetic tailing fraction contained 96% of the sulfur present in the briquetted mixture, and the magnetic fraction, containing the nickel values to be recovered by further processing, contained less than 4% of the sulfur.

TABLE I

| Fraction | Weight % | Analysis % Ni | Analysis % S | Distribution of Elements in each phase, % Ni | Distribution of Elements in each phase, % S |
|---|---|---|---|---|---|
| Magnetic | 12.7 | 8.3 | 7.1 | 89.0 | 3.6 |
| Non-Magnetic | 87.3 | 0.15 | 28.0 | 11.0 | 96.4 |

EXAMPLE II

Three parts of nickeliferous pyrrhotite containing about 0.82% nickel and ground to a particle size of 90% minus 200 mesh was mixed with one part of calcine (i.e., the same pyrrhotite roasted at 850° C. to a sulfur content of 0.2%) and 0.7 part of finely ground bituminous coal. The admixture was pressed into pillow shaped briquettes of approximately 3 centimeters by 2 centimeters by 1 centimeter and heated in a slightly reducing atmosphere (9.5% carbon dioxide, 5.0% water vapor, 9.5% carbon monoxide, 9.5% hydrogen and 66.5% nitrogen) at a temperature of 870° C. for ½ hour. After this thermal treatment the charge was cooled in a non-oxidizing atmosphere, ground in a wet pebble mill to 95% minus 325 mesh and subjected to wet magnetic separation at 2800 gauss. The results of this test are given in Table II. As can be seen from the results in Table II, 85.5% of the nickel associated with the pyrrhotite in the calcine reported in the magnetic fraction to provide a magnetic concentrate that contained 5.23% nickel. As also shown in Table II the non-magnetic fraction which comprises 87.2% of the admixture had a nickel content of only 0.13%. Thus, the amount of material that must be treated to ultimately recover the nickel values contained in the original pyrrhotite is only ½ of the original mass.

TABLE II

| Fraction | Weight % | Analysis, % Ni | Analysis, % S | Distribution of Elements in each phase, % Ni | Distribution of Elements in each phase, % S |
|---|---|---|---|---|---|
| Magnetic | 12.8 | 5.23 | 6.8 | 85.5 | 3.4 |
| Non-Magnetic | 87.2 | 0.13 | 28.0 | 14.5 | 96.6 |

EXAMPLE III

Six parts of nickeliferous pyrrhotite concentrate containing about 1.25% nickel and ground to a particle size of 90% minus 200 mesh was mixed with 1.1 parts of lime (CaO) and 1.1 parts of finely ground bituminous coal. The mixture was pressed into pillow shaped briquettes of approximately 3 centimeters by 2 centimeters by 1 centimeter and heated in a slightly reducing atmosphere (9.7% carbon dioxide, 7.1% water vapor, 9.6% carbon monoxide, 6.3% hydrogen and 67.3% nitrogen) at a temperature of 900° C. for ½ hour. After this thermal treatment the charge was cooled in a non-oxidizing atmosphere ground in a wet pebble mill to 95% minus 325 mesh and subjected to wet magnetic separation at 2800 gauss. The results of this test, given in Table III, show that 79.9% of the nickel associated with the pyrrhotite reported in the magnetic fraction which analyzed 5.80% nickel. The nonmagnetic fraction which comprised 84.4% of the mixture had a nickel content of only 0.27%. Thus, the amount of material that must be treated to ultimately recover the nickel values contained in the original pyrrhotite is only 1/6th of the original mass.

TABLE III

| Fraction | Weight, % | Analysis, % Ni | Nickel Distribution, % |
|---|---|---|---|
| Magnetic | 15.6 | 5.80 | 79.9 |
| Non-Magnetic | 84.4 | 0.27 | 20.1 |

EXAMPLE IV

Three parts of sulfidic nickel concentrate containing about 8.4% nickel and ground to a particle size of 90% minus 200 mesh was mixed with 0.7 part of fine iron powder and 0.15 part of finely ground bituminous coal. The mixture was pressed into pillow shaped briquettes of approximately 3 centimeters by 2 centimeters by 1 centimeter and heated in a slightly reducing atmosphere (9.5% carbon dioxide, 5.0% water vapour, 9.5% carbon monoxide, 9.5% hydrogen, and 66.5% nitrogen) at a temperature of 815° C. for 1 hour. After this treatment the charge was cooled in a non-oxidizing atmosphere, ground in a wet pebble mill to 95% minus 325 mesh and subjected to wet magnetic separation at 2800 gauss. The results, given in Table IV, show that 90.4% of the nickel contained in the feed reported in the magnetic fraction to provide a concentrate which analyzed 23.5% nickel. The non-magnetic fraction which comprised 74.2% of the mixture had a nickel content of only 0.87%. This fraction could be treated according to any of the processes described in Examples I, II or III to recover substantially all of its nickel content.

TABLE IV

| Fraction | Weight, % | Analysis, % Ni | Nickel Distribution, % |
|---|---|---|---|
| Magnetic | 25.8 | 23.5 | 90.4 |
| Non-Magnetic | 74.2 | 0.87 | 9.6 |

EXAMPLE V

Three parts of sulfidic nickel concentrate containing about 84.% nickel and ground to a particle size of 90% minus 20 mesh was mixed with one part of calcine (0.82% nickel pyrrhotite roasted at 850° C. to a sulfur content of 0.2%) and 0.6 part of finely ground bituminous coal. The mixture was pressed into pillow shaped briquettes of approximately 3 centimeters by 2 centimeters by 1 centimeter and heated in a slightly reducing atmosphere (9.7% carbon dioxide, 7.1% water vapour, 9.6% carbon monoxide, 6.3% hydrogen and 67.3% nitrogen) at a temperature of 815° C. for 1 hour. After this treatment the charge was cooled in a non-oxidizing atmosphere, ground in a wet pebble mill to 95% minus 325 mesh and subjected to wet magnetic separation at 2800 gauss. The results of this test, given in Table V, show that 82.4% of the nickel contained in the original feed reported in the magnetic fraction which analyzed 29.6% nickel. The non-magnetic fraction comprised 81.6% of the mixture and had a nickel content of 1.42%. This fraction could be treated according to any of the processes described in Examples I, II or III to recover substantially all of its nickel content.

TABLE V

| Fraction | Weight, % | Analysis, % Ni | Nickel Distribution, % |
|---|---|---|---|
| Magnetic | 18.4 | 29.6 | 82.4 |

TABLE V-continued

| Fraction | Weight, % | Analysis, % Ni | Nickel Distribution, % |
|---|---|---|---|
| Non-Magnetic | 81.6 | 1.42 | 17.6 |

EXAMPLE VI

One part of nickeliferous pyrrhotite containing about 1.25% nickel and ground to a particle size of 90% minus 200 mesh was mixed with 0.6 part of tailings from a leaching process (containing 39.5% iron primarily present as FeO(OH), 0.18% nickel, 4.3% sulfate ion and the remainder rock) and 0.3 part of finely ground bituminous coal. The mixture was pressed into pillow shaped briquettes of approximately 3 centimetes by 2 centimeters by 1 centimeter and heated in a slightly reducing atmosphere (9.7% carbon dioxide, 7.1% water vapour, 9.6% carbon monoxide, 6.3% hydrogen, 67.3% nitrogen) at a temperature of 900° C. for ½ hour. After this thermal treatment the charge was cooled in a non-oxidizing atmosphere, ground in a wet pebble mill to 95% minus 325 mesh and subjected to wet magnetic separation at 2800 gauss. The results of this test, given in Table VI, show that 83.3% of the nickel associated with the pyrrhotite and tailings reported in the magnetic fraction which analyzed 4.55% nickel. The non-magnetic fraction which comprised 85.1% of the mixture had a nickel content of only 0.16%. Thus, the amount of material that must be treated to ultimately recover the nickel values contained in the pyrrhotite and tailings is only 1/7th of the original mass.

TABLE VI

| Fraction | Weight, % | Analysis, % Ni | Nickel Distribution, % |
|---|---|---|---|
| Magnetic | 14.9 | 4.55 | 83.3 |
| Non-Magnetic | 85.1 | 0.16 | 16.7 |

EXAMPLE VII

Three parts of 1.25% nickel pyrrhotite were ground to 80% minus 200 mesh and blended with one part of calcined pyrrhotite (pyrrhotite roasted in air at 850° C. to a sulfur level of less than 0.2%) and 0.6 to 0.7 part of finely ground bituminous coal. Eight such mixtures were compacted into pillow-shaped briquettes of approximately 3 centimeters by 2 centimeters by 1 centimeter and treated individually in slightly reducing atmospheres (9.7% carbon dioxide, 7.1% water vapour, 9.6% carbon monoxide, 6.3% hydrogen, and 67.3% nitrogen) at various furnace temperatures in the range 814° C. to 1036° C. The periods of treatment were generally 20 minutes. The products of treatment at each temperature were ground in a web pebble mill to 95% minus 325 mesh and subjected to wet magnetic separation at 2800 gauss. The results, reported in Table VII, show that the nickel originally present in the pyrrhotite and calcine has been concentrated in the magnetic fraction to an extent which depends upon the temperature of treatment. For example, at 870° C., 900° C. and 925° C. approximately 87% of the nickel reported in the magnetic alloy concentrate, whereas at 814° C., 953° C. and 1036° C., respectively, 79.0%, 75.7% and 69.3% of the total nickel reported in the magnetic alloy concentrate. At 870° C. the magnetic alloy concentrate represents 13.3 weight percent of the treated charge with a magnetic fraction containing 8.3% nickel and a nonmagnetic fraction containing 0.19% nickel. At 1036° C. the magnetic alloy concentrate represents 23.6 weight percent of the treated charge with a magnetic fraction containing 4.0% nickel and a non-magnetic fraction containing 0.55% nickel. Optimum results were achieved in the temperature range 870° C. to 925° C.

TABLE VII

| Treatment Conditions | | | | | |
|---|---|---|---|---|---|
| Temp. ° C. | Time, Minutes | Fraction | Wt. % | Analysis % Nickel | Nickel Distribution % |
| 814 | 60 | Magnetic | 8.1 | 11.7 | 79.0 |
| | | Non-Magnetic | 90.9 | 0.26 | 21.0 |
| 870 | 30 | Magnetic | 13.3 | 8.26 | 87.0 |
| | | Non-Magnetic | 86.7 | 0.19 | 13.0 |
| 900 | 20 | Magnetic | 13.9 | 7.70 | 86.7 |
| | | Non-Magnetic | 86.1 | 0.20 | 13.3 |
| 925 | 20 | Magnetic | 14.3 | 7.55 | 86.8 |
| | | Non-Magnetic | 85.7 | 0.20 | 13.2 |
| 938 | 20 | Magnetic | 16.8 | 7.09 | 83.6 |
| | | Non-Magnetic | 83.2 | 0.28 | 16.4 |
| 953 | 20 | Magnetic | 17.5 | 6.27 | 75.7 |
| | | Non-Magnetic | 82.5 | 0.39 | 24.3 |
| 970 | 16 | Magnetic | 16.7 | 5.18 | 70.2 |
| | | Non-Magnetic | 83.3 | 0.44 | 29.8 |
| 1036 | 20 | Magnetic | 23.6 | 4.02 | 69.3 |
| | | Non-Magnetic | 70.4 | 0.55 | 30.7 |

Although the present invention has been described in conjunction with preferred embodiments, it is to be understood that modifications and variations can be resorted to without departing from the spirit and scope of the invention, as those skilled in the art will readily understand. Such modifications and variations are considered to be within the purview and scope of the invention and appended claims.

We claim:

1. A process for concentrating nickel values contained in nickeliferous ferruginous sulfide minerals having a stoichiometric excess of sulfur over iron with minimization of conversion of sulfide to $SO_2$, which consists in agglomerating an intimate admixture consisting of a finely-divided beneficiated sulfidic ore-concentrate containing said nickeliferous ferruginous sulfide minerals, finely-divided iron oxide and a reducing reagent, heating the agglomerates to between about 800° C. and 1000° C. in an atmosphere non-oxidizing to metallic iron and having a reducing potential equivalent to a $CO:CO_2$ ratio of between about 1:2 and 2:1 to reduce the iron oxide to metallic iron, to effect thermal diffusion of metal values in the admixture, and to concentrate nickel values in a metallic iron-containing fraction, cooling the heated agglomerates, comminuting the cooled agglomerates and separating the metallic iron-containing fraction from the remainder o the cooled admixture, said remainder of cooled admixture containing most of the sulfur, to provide a nickel concentrate; whereby nickel values are concentrated and the formation of $SO_2$ is minimized.

2. The process as described in claim 1 wherein the nickeliferous furruginous sulfide mineral is pyrrhotite.

3. The process as described in claim 2 wherein the finely divided iron oxide is a calcine of pyrrhotite roasted to a sulfur content of less than about 5%.

4. The process as described in claim 3 wherein the admixture has a calcine to pyrrhotite ratio between about 0.15:1 and 5:1.

5. The process as described in claim 4 wherein the reducing reagent is a solid reductant.

6. The process as described in claim 5 wherein the reductant is added to the admixture in amounts between about 20% and 70% of the weight of the calcine.

7. The process as described in claim 5 wherein the reductant is added to the admixture in amounts between about 25% and 50% of the weight of the calcine.

8. The process as described in claim 6 wherein the reductant has a particle size distribution of at least about 80% minus 65 mesh.

9. The process as described in claim 6 wherein the agglomerates are heated to a temperature between about 850° C. and 925° C.

10. The process as described in claim 6 wherein the agglomerates are cooled, crushed to a particle size distribution of at least about 80% minus 200 mesh and the nickel concentrate is recovered by magnetic separation.

11. The process as described in claim 6 wherein the process is conducted in a rotary hearth furnace in which the agglomerates do not move relative to the hearth.

12. The process described in claim 7 wherein the agglomerates are formed by briquetting.

13. A process for concentrating non-ferrous metal values contained in a ferruginous sulfide mineral having a stoichiometric excess of sulfur over iron, wherein the ferruginous sulfide mineral is a nickel bearing material comprising at least one mineral selected from pyrrhotite and pentlandite, with minimization of conversion of sulfide to $SO_2$, which consists essentially of agglomerating an intimate admixture consisting of a beneficiated sulfidic ore-concentrate containing said ferruginous sulfide mineral and a metallic iron-producing agent selected from the group consisting of metallic iron, an iron oxide plus a reducing agent, and at least one oxide selected from an alkali metal oxide and an alkaline earth metal oxide plus a reducing agent, heating said agglomerated admixture at a temperature in the range of about 800° C. to about 1000° C. in an atmosphere having a reducing potential equivalent to a $CO:CO_2$ ratio of between about 1:2 and 2:1, said atmosphere being non-oxidizing to metallic iron, for a period of time sufficient to effect thermal diffusion of metal values in the admixture and to concentrate a preponderant part of the non-ferrous metals in a metallic iron-containing fraction, cooling and comminuting the resultant material, and separating the metallic fraction from the remaining material, said remaining material retaining most of the sulfur, to provide a concentrate of non-ferrous metals in a metallic iron-containing fraction; whereby nickel values are concentrated and the formation of $SO_2$ is minimized.

14. The process as described in claim 13 comprising agglomerating an intimate admixture of said beneficiated sulfidic ore-concentrate in particulate form, particulate iron oxide and a reducing reagent, heating the agglomerates to between about 800° C. and 1000° C. in an atmosphere non-oxidizing to metallic iron sufficiently long to reduce the iron oxide to metallic iron and to concentrate a preponderant part of the non-ferrous metal values in the metallic iron-containing fraction.

15. The process as described in claim 13 comprising agglomerating an intimate admixture of said beneficiated sulfidic ore-concentrate in particulate form and particulate metallic iron, heating and maintaining the agglomerates at a temperature between about 800° C. and 1000° C. in an atmosphere non-oxidizing to metallic iron sufficiently long to concentrate a preponderant part of the nickel values in the iron-containing fraction.

16. The process as described in claim 13 comprising agglomerating an intimate admixture of said beneficiated sulfidic ore-concentrate in particulate form and at least one oxide selected from the group consisting of alkali metal and alkaline earth metal, heating and maintaining the agglomerates at a temperature between about 800° C. and 1000° C. in the presence of a reducing agent and in an atmosphere non-oxidizing to metallic iron sufficiently long to convert iron sulfide to metallic iron and to concentrate a preponderant part of the non-ferrous metal values in the iron-containing fraction.

17. The process as described in claim 14 wherein the reducing agent is a particulate carbonaceous material.

18. The process as described in claim 16 wherein the oxide is calcium oxide.

19. The process as described in claim 14 wherein the particulate iron oxide comprises a calcine of pyrrhotite.

20. The process as described in claim 19 wherein the calcine is roasted to a sulfur content of less than 5%.

21. The process as described in claim 16 wherein the reducing agent is a particulate carbonaceous material.

22. A process for concentrating non-ferrous metal values contained in a nickeliferous ferruginous sulfide mineral having a stoichiometric excess of sulfur over iron with minimization of conversion of sulfide to $SO_2$, which consists essentially of agglomerating an intimate admixture consisting of a beneficiated sulfidic ore-concentrate containing said ferruginous sulfide mineral and a metallic iron-producing agent selected from the group consisting of metallic iron, an iron oxide plus a reducing agent, and at least one oxide selected from an alkali metal oxide and an alkaline earth metal oxide plus a reducing agent, treating said agglomerates in a furnace in which the agglomerates do not move relative to the hearth at a temperature in the range of about 800° C. to about 1000° C. and in an atmosphere having a reducing potential equivalent to a $CO:CO_2$ ratio between about 1:2 and 2:1, said atmosphere being non-oxidizing to metallic iron, for a period of time sufficient to effect thermal diffusion of metal values in the admixture and to concentrate a preponderant part of the non-ferrous metals in a metallic iron-containing fraction, cooling and comminuting the resultant material, and separating the metallic fraction from the remaining material, said remaining material retaining most of the sulfur, to provide a concentrate of non-ferrous metals in a metallic iron-containing fraction; whereby metal values are concentrated and the formation of $SO_2$ is minimized.

23. The process as described in claim 17 wherein the agglomerates are treated in the furnace at a temperature about 870° C. up to about 925° C.

24. The process as described in claim 22 wherein the nickeliferous ferruginous sulfide mineral is pyrrhotite, the metallic iron-producing agent is a finely divided calcine of pyrrhotite roasted to a sulfur content of less than about 0.2% and finely ground bituminous coal and the admixture has a calcine to pyrrhotite ratio of about 1 to 3.

25. A process for concentrating non-ferrous metal values contained in a ferruginous sulfide mineral, said mineral having a stoichiometric excess of sulfur over iron, which consists essentially of agglomerating an intimate admixture of a beneficiated sulfidic ore concentrate containing said ferruginous sulfide mineral and metallic iron-producing agent selected from the group consisting of metallic iron, an iron oxide plus a reducing agent, and at least one oxide selected from an alkali metal oxide and an alkaline earth metal oxide plus a reducing agent, said admixture consisting essentially of said agglomerated admixed material, heating said agglomerated admixture at a temperature in the range of about 800° C. to about 1000° C. in an atmosphere non-oxidizing to metallic iron for a period of time sufficient to effect thermal diffusion of metal values in the mixture and to concentrate a preponderant part of the non-ferrous metal in a metallic iron-containing fraction, cooling and comminuting a resultant material, and separating the metallic fraction from the remaining material to provide a concentrate of non-ferrous metals in a metallic iron-containing fraction.

26. A process as described in claim 14 wherein the particulate iron oxide comprises tailings containing an iron oxide and nickel.

* * * * *